US006851966B1

(12) United States Patent
Tomasino

(10) Patent No.: US 6,851,966 B1
(45) **Date of Patent: *Feb. 8, 2005**

(54) T-TAP CONNECTOR

(75) Inventor: Guy Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/443,115

(22) Filed: May 22, 2003

Related U.S. Application Data

(63) Continuation-in-part of application No. 09/920,328, filed on Aug. 2, 2001, now Pat. No. 6,568,952.
(60) Provisional application No. 60/222,590, filed on Aug. 2, 2000.

(51) Int. Cl.[7] ..... H01R 4/24
(52) U.S. Cl. ..... 439/411; 439/425
(58) Field of Search ..... 439/411–414, 417–419, 439/425–428, 801, 784

(56) References Cited

U.S. PATENT DOCUMENTS

| | | | | | |
|---|---|---|---|---|---|
| 2,567,783 | A | * | 9/1951 | Richardson | 439/411 |
| 2,759,095 | A | * | 8/1956 | Kline | 439/411 |
| 3,602,872 | A | * | 8/1971 | Braunstein | 439/425 |
| 3,877,773 | A | * | 4/1975 | Doty et al. | 439/406 |
| 3,902,780 | A | * | 9/1975 | Dola | 439/411 |
| 3,951,503 | A | * | 4/1976 | Caulkins | 439/427 |
| 4,878,855 | A | * | 11/1989 | Heng et al. | 439/411 |
| 5,228,875 | A | | 7/1993 | Swenson, Sr. | 439/784 |
| 5,695,369 | A | | 12/1997 | Swenson, Sr. | 439/784 |
| 5,789,706 | A | | 8/1998 | Perkins | 174/65 R |

* cited by examiner

*Primary Examiner*—Gary Paumen
(74) *Attorney, Agent, or Firm*—Jim Zegeer

(57) ABSTRACT

A T-tap connector with a common conductive element in a housing has a one end shaped to clamp a wire thereto and the opposite end sharpened and adapted to pierce the insulation on a main wire. Threaded connections are utilized to multiply the force to press the main conductor wire to the sharp point.

5 Claims, 4 Drawing Sheets

T-TAP CONNECTOR

REFERENCE TO RELATED APPLICATION

This application is a continuation-in-part of my application Ser. No. 09/920,328 filed Aug. 2, 2001 now U.S. Pat. No. 6,568,952, and entitled T-Tap CONNECTOR which is the subject of provisional application Ser. No. 60/222,590 filed Aug. 2, 2000.

BACKGROUND AND BRIEF DESCRIPTION OF THE INVENTION

The present invention relates to a wire connector for tapping to a wire particularly low-voltage hot-wire such as in a vehicle 12-volt and 24-volt systems. The invention also pertains to tapping into wires without severing or splicing the wire. In the prior art, tapping into a main or a hot wire or tying wires together is frequently done by one cut of the main wire and stripping the insulation from the wire ends and twisting or crimping the three (or more) wires together. A further technique in the prior art is to strip the insulation off the main or hot wire and wrap and solder the accessory wire thereon and then cover them with heat-shrink to reinsulate them. A third technique is used "Scotch Lok" (TM) type connector which taps into each wire with a blade shape that can in some instances destroy the wire strands and easily come apart.

An object of the present invention is to provide a T-tap into a wire without severing the wire or splicing the wire or with unusual tools or stripping the hot wire.

A further object of the invention is to provide a T-tap into an insulated main which substantially maintains the integrity of the main wire.

A further object of the invention is to provide a T-tap connector which will not pull apart or vibrate.

A further object of the invention is to provide a T-tap connector which has significantly less resistance than crimping or soldering into a T-tap.

According to the present invention, a T-tap connector is provided for connecting into the main insulated wire. It is comprised of a non-conductive housing member having first and second chambers and a wall separating the first and second chambers and colinear with the central axis. Each chamber has a threaded connection wall and a central axis and a common conductive member mounted in the wall separating the first and second chambers. The common conductive member has an insulation piercing sharp point on one end thereof and a means at the opposite end for clamping a wire thereto. In one embodiment, the means for clamping is according to the technique disclosed in Swenson, Sr. U.S. Pat. No. 5,228,875 wherein a bullet-shaped end is formed on the common conductive member and a first non-conductive coupling member having a threaded annular wall and an internal throughbore has one end of the throughbore shaped to clamp at least one bare wire end to the bullet-shape end of a common conductive element. In another embodiment, the conductive element has a hollow bore and a transverse ball which is urged by the non-conductive coupling member into the hollow bore of the common conductive member.

A second non-conductive coupling member is provided. The second non-conductive coupling member has a threaded surface which is adapted to threadably engage with the threaded connection wall on the second chamber bearing the sharp point end of the conductive element. The second non-conductive coupling member has a pair of aligned slots therein for receiving and transversely centering the main insulated conductor wire with the sharp point. The second non-conductive coupling member is adapted, when threadably engaged with the threaded connection wall of the second chamber, to multiply the manually applied twisting force to thereby drive the sharp point into the sharp point into the main conductor wire whereby the sharp point pierces the insulation on the main conductor wire, and wire strands are pushed or moved around making full electrical contact, thereby connecting the main conductor wire to at least one bare wire end. No wire strands are broken, and the wire integrity is maintained.

Thus, there is provided a method and apparatus for tapping into wires without splicing or stripping into the wire. The invention is particularly applicable to low voltage situations (automotive, boats, planes, etc.) for tapping into hot wires. The invention, however, is not limited to low-voltage applications.

In all cases, for safety, it is highly advisable to remove power from the circuit in which the hot wire is located so that the connection is made while there is no power on the wire.

DESCRIPTION OF THE DRAWINGS

The above and other objects, advantages and features of the invention will become more apparent when considered with the following specification and accompanying drawings, wherein.

DETAILED DESCRIPTION OF THE INVENTION

Figure 1:
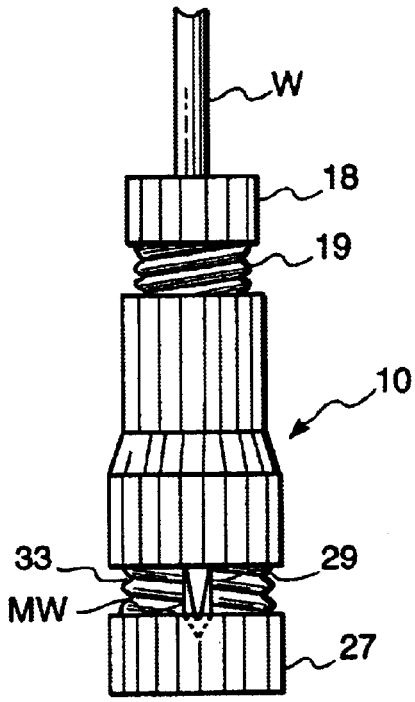
FIG. 1 is a side elevational view of one embodiment of the invention.
Figure 2:
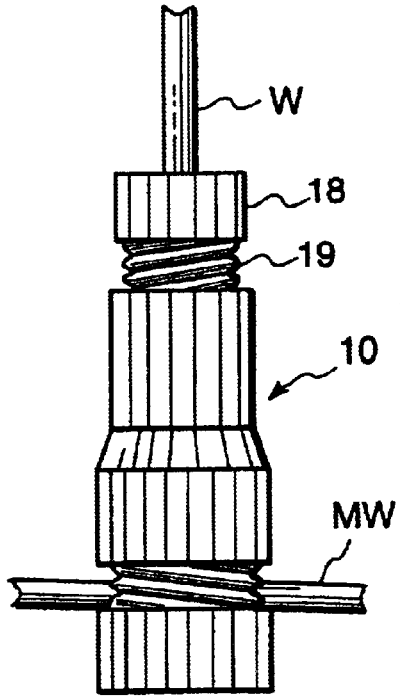
FIG. 2 is a side elevational view from another perspective.
Figure 3:
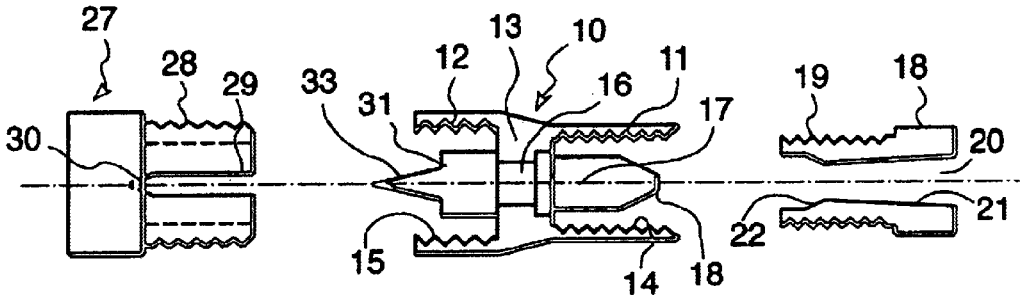
FIG. 3 is an exploded sectional view of a preferred embodiment of the invention.
Figure 4:
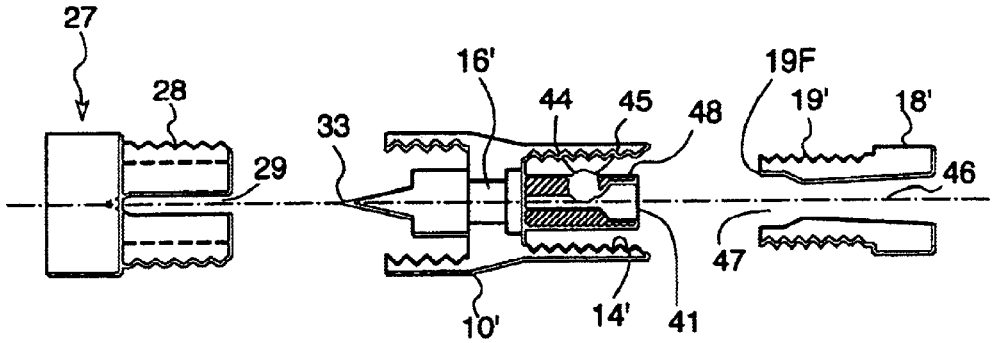
FIG. 4 is an exploded sectional view of a further preferred embodiment of the invention.
Figure 5A:
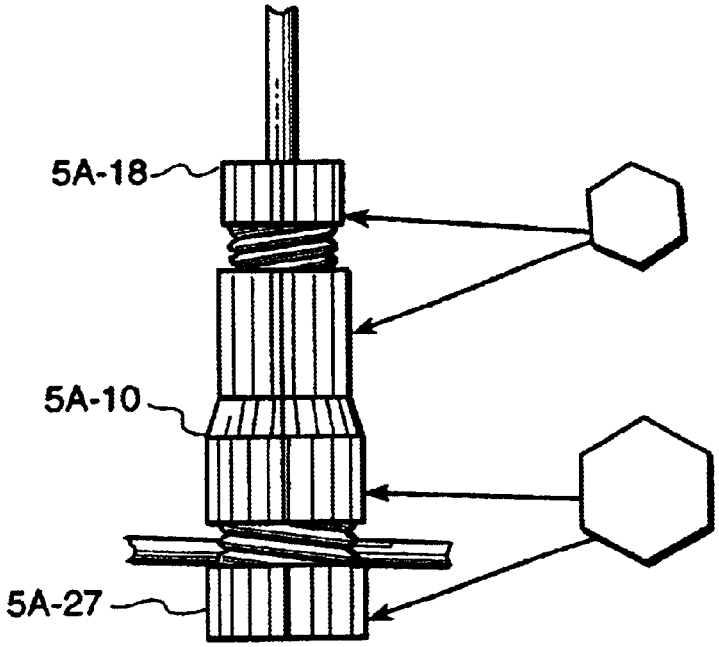
FIGS. 5A–5D are side elevational views which have various external shapes appended to the male and female components.
Figure 5B:
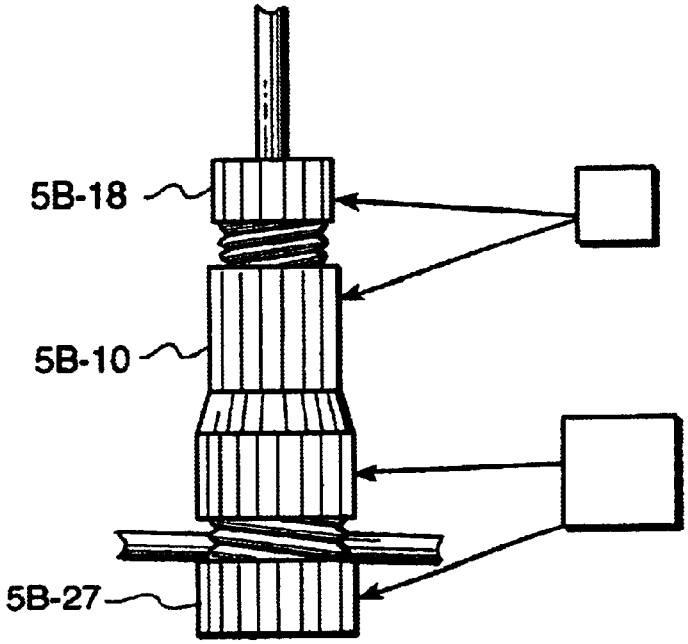
Figure 5C:
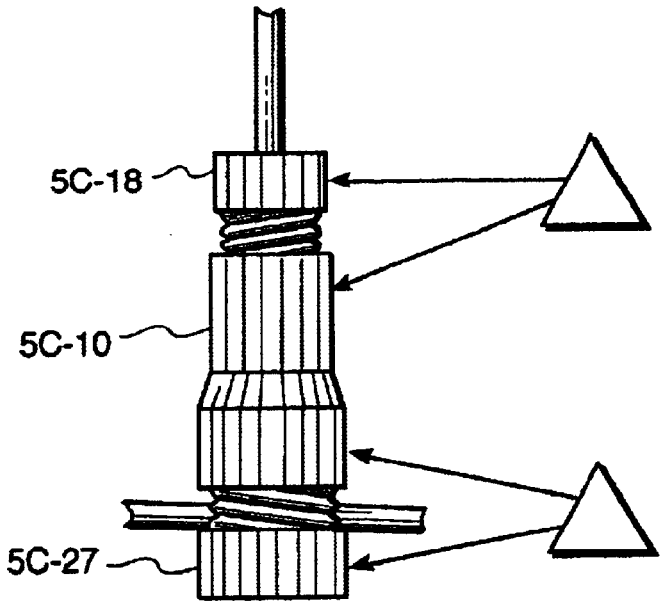
Figure 5D:
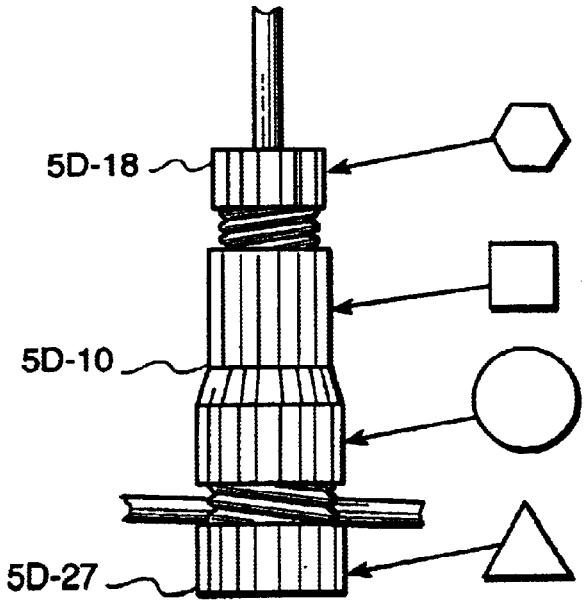

Referring to the drawings, there is illustrated two preferred embodiments of the invention. The first embodiment is shown in FIG. 3, and the second preferred embodiment is shown in FIG. 4. FIGS. 1 and 2 encompass the embodiments. As illustrated in FIG. 3, a non-conductive housing member 10 has first and second chambers 11 and 12 respectively, separated by a wall 13. Each chamber has a threaded connection wall 14 and 15, respectively. A common conductor member 16 is mounted in wall 13 and is coaxially centered in non-conductive housing member 10 and has a shoulder 17 set into wall 13. The end 18 of common conductive element 16 is in chamber 11 and is, in this embodiment, bullet-shaped to serve as a means for clamping the wire in conjunction with a first non-conductive coupling member 18 which, in turn, has a threaded surface 19 for threaded engagement with the threaded connection wall 14.

Non-conductive coupling member 18 has an internal throughbore 20 which is adapted to receive one or more wires w which have their ends stripped. The throughbore 20 has first and second ends 21 and 22 with end 22 being complementary shaped to the end of bullet-shaped end 18 of common conductive element 16 such that the spare stripped ends of wires fed through throughbore 20 splay on the end 18 of common conductive element 16. By the threaded engagement of threaded connection wall 14 with threaded surface 19 on the coupling member 18, wires splayed on bullet-shaped end 25 are securely clamped between the surfaces 22 and 18.

Second non-conductive coupling member 27 has a threaded surface 28 which is adapted to threadably engage with threaded connection 15 on non-conductive housing member 10. The coupling member 27 is provided with a main wire receiving slot 29 and has a base cavity 30. The common conductive member 16 has a portion thereof 31 which is larger than the passage through wall 13 and operates in conjunction with shoulder 17 so that forces applied coaxially on the conductive member from either end cannot dislodge or shift or cause movement of the conductive element 16 in housing 10. The tip 32 of conductive member 16 is sharpened to a sharp point 33 so as to be able to pierce insulation on main conductor wire MW seated in notch or slot 29.

In one preferred embodiment, the coupling member 27 has a larger diameter than coupling member 18 to enhance the force for piercing the insulated wire. In other preferred embodiments, they are the same diameter.

Referring to FIGS. 1 and 2, in operation, a main wire MW is seated in the slot 29, and the threads 15 in housing member 12 are threadably engaged with threads 28 on the second non-conductive coupling member 27; and turning the main housing member 10 causes the threaded connection wall and the threads 28 to multiply the manual twisting force to cause the sharp needle point 33 to pierce the main conductor wire MW until it engages the conductor carried inside the insulated wire MW.

At the opposite end, first non-conductive coupling member 18 has a wire with its bare end passing therethrough and its threads 19 threadably engaged with threads 14 of housing portion 10. By a relative rotation between the non-conductive housing portion 11 and the non-conductive coupling element 18, the bare ends of the wires are clamped between the clamping surfaces 22 and 23.

It will be appreciated that the main wire MW may be pierced first and then the second wire w clamped or the order reversed.

It will noted that the non-conductive housing member and the first and second non-conductive coupling members have knurlations as shown in FIGS. 1 and 2 to enhance finger gripping between the thumb and fingers. However, it will be appreciated that hexagon, square or triangular outside surfaces can be used as well in combinations thereof. See FIGS. 5A–5D for illustrations thereof. The components correspond to the components in FIG. 1 preceded by the figure number and letter.

In the embodiment shown in FIG. 4, the main wire piercing component portion of the invention is identical to that previously described in connection with FIG. 3. The basic difference in the two embodiments lies in the manner of clamping the end of wire W to the common conductive member 13. In the embodiment shown in FIG. 4, the right end of the common conductive element 13 has a stepped bore 40 with the entrance end 41 larger than the base portion 42 to serve as a guide for the twisted wire ends of the second wire(s) W. In this embodiment, a ball member 44 is fitted in a transverse opening 45. The second non-conductive coupling member 18' has threads 19' and a throughbore 46 which has an end 47 is adapted to telescope over the entrance end 41 of common conductive member 13'. with the bare end of wire W inserted through throughbore 46 into the portion 42, and with the threads 19' threadably engaged with threads 14', relative rotation between the non-conductive housing member 10' and the non-conductive coupling member 18' advances the end 19E where it engages ball 45 and cams the ball 45 inwardly to thereby clamp the wire securely in the passage 42. The piercing of the wire MW by point 33 is as described earlier in connection with FIG. 3.

It will be appreciated that threads 15 may be placed on the exterior of non-conductive housing member 10 and the threads 28 placed on the interior of non-conductive coupling member 27. It will be noted that the sharp wire-piercing point 33 extends beyond the housing 10 and into a recess 30.

One or more accessory wires may be stripped and inserted into the opposing end of the coupling member and locked-in using either the embodiment shown in FIG. 3 or FIG. 4, respectively.

The T-tap end connector of this invention has many uses including extending all "hot wires" without splicing or stripping into the hot wire. It can be used for automobile add-on's, such as alarms, lighting and stereos, but is not limited to these uses.

The present invention is superior to prior art T-tap techniques in that:

1. It has the ability to tap into wire a without tools, splicing or stripping of the main wire insulation.
2. It maintains the integrity of the hot wire without exposing the user to the voltage.
3. The wire strands of the main wire remain intact.
4. Tap-in into the hot lead will not pull apart or vibrate loose.
5. There is less resistance as compared to crimping or soldering.

While the preferred embodiment of the invention has been shown and described, it will be apparent to those skilled in the art that other modifications, adaptations and changes to the invention will be readily apparent to those skilled in the art.

What is claimed is:

1. A T-tap connector for connecting into a main insulated conductor wire comprising in combination, a nonconductive housing member having first and second chambers, a wall separating said first and second chambers, each chamber having a threaded connection wall and a central axis, a common conductive member mounted in the wall separating said chambers, said common conductive member having an insulation-piercing sharp point on one end thereof and a means at the opposite end for clamping a wire thereto, a first nonconductive coupling member having a threaded annular wall and an internal throughbore, said throughbore having first and second ends with one of said ends being shaped to clamp at least one bare wire end to said common conductive element when the threaded wall on said first nonconductive coupling member is threadably engaged with the threaded wall of said first chamber, a second nonconductive coupling member, said second nonconductive coupling member having a threaded surface which is adapted to threadably engage with the said threaded connection wall on said second chamber having said sharp point, said second nonconductive coupling member and having a pair of aligned slots therein for receiving and centering said main insulated conductor wire with said sharp point, being adapted when threadably engaged with the threaded connection wall of said second chamber multiply the force to press said main conductor wire into engagement with said sharp point, whereby said sharp point pierces the insulation of said main insulated conductor wire to thereby electrically connect said main insulated conductor wire to said at least one bare wire end.

2. The T-tap connector as defined in claim 1 wherein one of said coupling members has a larger diameter than the other of said coupling members to enhance the force for piercing said insulated wire.

3. The T-tap connector as defined in claim 1 wherein said common conductive member has an enlargement on both sides of said wall so that forces applied coaxially to said conductive member from either end cannot dislodge or shift or cause movement of said conductive element in said housing.

4. The T-tap connector as defined in claim 1 wherein said means at the opposite end for clamping a wire thereto comprises a bullet-shape on said common conductive member and a corresponding shape on said first non-conductive member for clamping wire therebetween.

5. The T-tap connector for connecting into a main insulator wire as defined in claim 1 wherein said means at the opposite end for clamping a wire thereto includes a bore in said common conductive member into which a wire end is inserted and a ball member is mounted in said common conductive member and said first non-conductive member cams said ball member into engagement with said wire to thereby clamp said at least one bare wire to said common conductive element when said threaded wall on said first non-conductive coupling member is threadably engaged with said threaded wall of said first chamber.

* * * * *